US009353596B2

(12) United States Patent
Raggio

(10) Patent No.: US 9,353,596 B2
(45) Date of Patent: May 31, 2016

(54) OIL WELL PLUG AND METHOD OF USE

(71) Applicant: Rayotek Scientific, Inc., San Diego, CA (US)

(72) Inventor: William Raggio, Del Mar, CA (US)

(73) Assignee: Rayotek Scientific, Inc., San Diego, CA (US)

( * ) Notice: Subject to any disclaimer, the term of this patent is extended or adjusted under 35 U.S.C. 154(b) by 381 days.

(21) Appl. No.: 14/029,957

(22) Filed: Sep. 18, 2013

(65) Prior Publication Data

US 2015/0075773 A1 Mar. 19, 2015

(51) Int. Cl.

| | |
|---|---|
| ***E21B 33/12*** | (2006.01) |
| ***E21B 33/13*** | (2006.01) |
| ***E21B 33/128*** | (2006.01) |
| ***E21B 33/129*** | (2006.01) |
| ***E21B 33/134*** | (2006.01) |

(52) U.S. Cl.

CPC ..... *E21B 33/128* (2013.01); *E21B 33/1208* (2013.01); *E21B 33/129* (2013.01); *E21B 33/134* (2013.01)

(58) Field of Classification Search

CPC . E21B 33/128; E21B 33/1208; E21B 33/129; E21B 33/134; E21B 33/1293

See application file for complete search history.

(56) References Cited

U.S. PATENT DOCUMENTS 1,263,933 A * 4/1918 Robinson ..... E21B 33/134 166/192
1,896,482 A * 2/1933 Crowell ..... E21B 33/134 166/115
2,230,712 A * 2/1941 Bendeler ..... E21B 33/128 166/123
2,725,621 A * 12/1955 Gates ..... E21B 17/12 206/303
3,051,241 A * 8/1962 Barrington ..... E21B 33/134 166/143
3,181,614 A * 5/1965 Brown ..... E21B 33/1295 166/122
3,399,729 A * 9/1968 McGill ..... E21B 33/12955 166/120
4,281,840 A * 8/1981 Harris ..... E21B 33/1208 277/342
5,197,547 A * 3/1993 Morgan ..... E21B 23/006 166/181
5,479,986 A 1/1996 Gano et al.
5,924,696 A 7/1999 Frazier
6,095,247 A 8/2000 Streich et al.

(Continued)

FOREIGN PATENT DOCUMENTS

WO 2009/116871 A1 9/2009

*Primary Examiner* — Jennifer H Gay
(74) *Attorney, Agent, or Firm* — Thompson Coburn LLP

(57) ABSTRACT

A frac plug is configured to seal a bore of a pipe of a downhole well. The frac plug comprises a generally cylindrical plug member comprising a glass body. The glass body may be tempered or high-compression glass. The plug member has axial opposite ends and a length extending between the axial ends. The plug member has an outer diameter surface extending along the length. The outer diameter surface is tapered. The frac plug further comprises a seal of compressible material extending substantially around the plug member outer diameter. The seal has opposite axial ends generally corresponding to the axial ends of the plug member. The seal is movable axially relative to the plug member outer diameter surface. The seal is compressible against the plug member outer diameter surface and expandable radially outward to engage the bore of the pipe.

3 Claims, 4 Drawing Sheets

(56) References Cited

U.S. PATENT DOCUMENTS 6,478,093 B1 * 11/2002 Hilts ..... E21B 23/00 166/120
8,205,671 B1 * 6/2012 Branton ..... E21B 33/1216 166/118
8,490,689 B1 * 7/2013 McClinton ..... E21B 23/06 166/135
8,651,180 B2 * 2/2014 Jara ..... E21B 33/1208 166/120
8,887,818 B1 * 11/2014 Carr ..... E21B 33/1204 166/118
9,097,095 B2 * 8/2015 VanLue ..... E21B 33/128
2005/0023000 A1 * 2/2005 Warren ..... E21B 21/10 166/380
2007/0074873 A1 * 4/2007 McKeachnie ..... E21B 33/1294 166/376
2007/0119600 A1 * 5/2007 Slup ..... E21B 33/134 166/387
2009/0011247 A1 * 1/2009 Barlow ..... B29C 70/085 428/413
2009/0107664 A1 * 4/2009 Jara ..... E21B 33/1208 166/101
2010/0155050 A1 * 6/2010 Frazier ..... E21B 33/12 166/102
2011/0000663 A1 1/2011 Brandsdal
2011/0240295 A1 * 10/2011 Porter ..... E21B 33/12 166/308.1
2011/0272138 A1 * 11/2011 Jara ..... E21B 33/1208 166/101
2012/0125631 A1 5/2012 Entchev et al.
2012/0125637 A1 * 5/2012 Chenault ..... E21B 33/1204 166/382
2012/0168152 A1 7/2012 Casciaro
2012/0181032 A1 7/2012 Naedler et al.
2013/0014933 A1 1/2013 Brandsdal et al.
2014/0311752 A1 * 10/2014 Streich ..... E21B 33/1204 166/376
2015/0075773 A1 * 3/2015 Raggio ..... E21B 33/128 166/135
2015/0075774 A1 * 3/2015 Raggio ..... E21B 33/129 166/135

* cited by examiner

OIL WELL PLUG AND METHOD OF USE

BACKGROUND AND SUMMARY

This disclosure generally relates to an oil well plug for use in oil well drilling. More particularly, the disclosure relates to an improved frac plug that may be used to temporarily or permanently plug a wellbore. More specifically, the frac plug may be made of a glass material which may be disintegrated as may be desired to re-establish flow in the well. The frac plug may be configured to receive a ball to form a one-way ball valve and thus form a pressure seal at the high pressure section of the wellbore. As described in greater detail, the frac plug and frac ball may be mostly made from a glass or other frangible material. When it is desired to remove the plug from the pipe, it is only necessary to disintegrate the glass portion of the plug, enabling it to fall away to reestablish flow through the pipe. Further features and advantages, as well as the structure and operation of various embodiments, are described in detail below with reference to the accompanying drawings.

DETAILED DESCRIPTION

Figure 1:
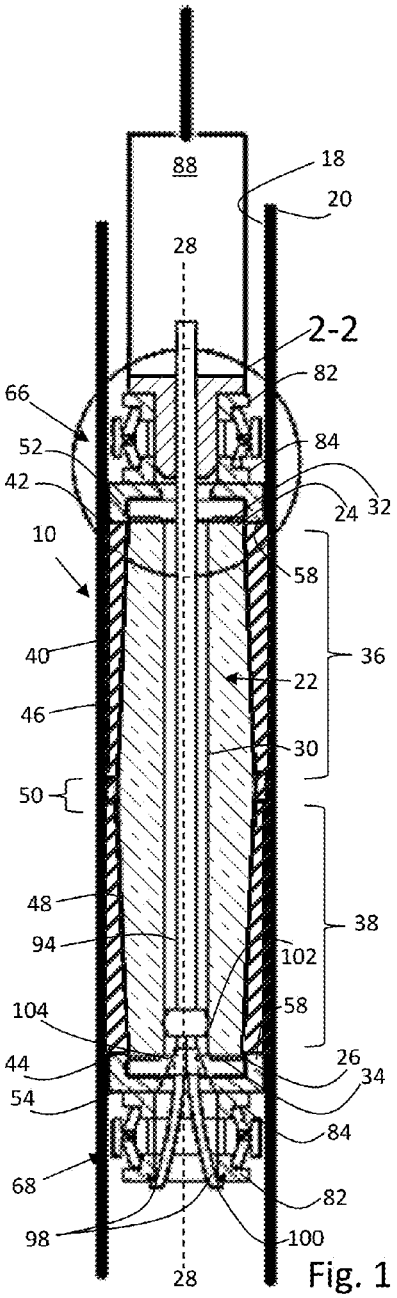
FIG. 1 shows a cross-sectional view of a frac plug prior to installation in a wellbore.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below," "top" and "bottom" and the like are used as words of convenience to provide reference points relative to the orientation in the drawings and are not to be construed as limiting terms.

FIG. 1 shows a frac plug 10 disposed in a bore 18 of a pipe 20 of a down hole well. The frac plug 10 comprises a plug member 22 that is generally a cylindrical body with opposite top and bottom axial ends 24,26 and center axis 28 extending therebetween. The plug member 22 may be provided with a draw bar shaft opening 30 extending between the top and bottom axially opposite ends 24,26. The draw bar shaft opening 30 may be aligned with the center axis 28. The plug member 22 may comprise a glass material. As shown in the drawings, the plug member 22 is monolithically formed from the glass material with the glass material extending from the top axial end to the bottom axial end. In the alternative, but not in a limiting sense, the glass material may be contained within the plug member. For instance, the plug member may have a glass insert formed within the plug member. The axial ends of the glass material plug member may be formed with protective pads 32,34 to distribute the load to be applied to the axial ends of the plug member and to prevent inadvertent contact of the glass material with hardened materials. The protective pads 32,34 may be formed of hard rubber or other similar material.

The glass material may be based upon a fused quartz, borosilicate or soda lime. After forming, the glass material may be treated to form tempered glass or ultra high compression, pre-tensioned glass. The glass material may be chemically strengthened. For example, the glass material may be immersed in an ion bath at an elevated temperature. The ion bath may result in an ion exchange at the surface of the glass creating a uniform surface compression layer. The surface compression layer may increase the strength of the glass material and make it more frangible.

The plug member 22 may have an outer diameter surface that is tapered. The surface may be tapered from a point between the top and bottom axial ends 24,26. As shown in the drawings, the outer diameter surface of the plug member may be tapered from a midpoint of the plug member to each respective opposite axial end, such that the diameter at the top and bottom axial ends is less than the midpoint. In this configuration, the plug member with its two opposed tapered surfaces may define first and second mandrel portions 36,38 corresponding to each tapered surface of the plug member with each mandrel portion formed on a respective top or bottom portion of the plug member. For instance, when the tapers extend from a midpoint of the plug member 22 to each axial end 24,26, the midpoint will define the first and second mandrel portions 36,38 of the plug member. The tapers may also be formed in a direction opposite to that shown in the drawings with each tapered portion having a corresponding mandrel portion. The taper may be approximately 3 degrees to approximately 7 degrees relative to the centerline 28. Further, it is not necessary that the taper begin at the midpoint. As will become evident from the discussion that follows, to provide a uniform loading of compressive force on the plug member and the glass material, the plug member may be generally symmetrical along its length and cross-section.

The frac plug comprises a seal 40 around the plug body 22. The seal 40 is a generally tubular member with a hollow interior receiving the plug member and an outer diameter surface configured to frictionally engage and seal against the bore 18 of the pipe 20 of the down hole well. The seal may have opposite, top and bottom axial ends generally corresponding to the axial ends of the plug member 22. The seal 40 may have a key engagement surface 42,44 at each axial end of the seal. Each key engagement surface 42,44 may be arranged generally adjacent to the plug member axial ends 24,26. The seal 40 may comprise a compressible material, for instance, a rubber-like material with an outside surface embedded with a coarse, abrasive material to allow the seal outer surface to frictionally engage, as well as form a seal, with the bore of the pipe. The seal is configured to move or slide axially along the outer diameter surface of the plug member so as to be compressed against the outer diameter surface of the plug member and expand radially outward to contact the bore of the pipe of the downhole well. As shown in the drawings, the seal has an inner diameter surface that is tapered to match the tapers formed on the respective mandrel portions of the outer diameter of the plug member. In this configuration, the seal has first and second (or top and bottom) sealing members 46,48 which substantially surround their respective mandrel portions 36,38, and each of the sealing members 46,48 may be separated from each other along the length of the plug member by a distance 50. The sealing members 46,48 may be configured to move axially relative to the plug member outer diameter surface. As the seal members 46,48 move axially relative to the plug member outer diameter surface to reduce the distance 50, the seal members are compressed against the plug member outer diameter surface and expand radially outward enabling the seal to engage the bore of the pipe. The seal members may move toward each other such that the seal members abut, thereby forcing the seal to compress against the plug member outer diameter surface and allowing the seal to expand radially outward to engage the bore of the pipe. The matching tapered surfaces of the sealing members and mandrel portions facilitate diametrical expansion of the seal.

The frac plug 10 may be provided with first and second (or top and bottom as shown in the drawings) setting keys 52,54. Each setting key may be positioned adjacent an axial end 24,26 of the plug member. The setting key may comprise a disc with an axially extending rim 58 on one face configured to engage the key engagement surfaces 42,44 of the seal. An opposite face 60 of the setting key may be flat to cooperate with a clamping flange, as will be described below. As the setting keys 52,54 move axially (downward for the top key and upward for the bottom key), the setting keys may engage their respective key engagement surfaces 42,44 of the sealing members 46,48, thereby forcing the sealing members to move axially along the plug member outer diameter surface. This in turn forces the seal to compress against the plug member outer diameter surface and expand radially outward to engage the bore of the pipe. The first or top setting key 52 may have a seating surface 62 that forms a seal with a frac ball as explained below in greater detail. An operator 64 of an actuator may position the first or top setting key 52 as desired as will be discussed in greater detail below.

The frac plug may be provided with a clamp to enable the frac plug to be positioned and held in place in the bore of the pipe. In one embodiment, the clamp has first and second (or top and bottom) clamping portions 66,68. Each of the clamping portions may generally correspond to an axial end 24,26 of the plug member. Each of the clamping portions 66,68 may have one or more shoe members 72,74, having a arcuate shape so as to be conformable with the bore of the pipe. The shoe members may be diametrically opposed and/or form an annulus-like structure. The one or more shoe members may have a contact outer surface that engages the bore of the pipe. The contact outer surface of each of the shoes 72,74 may be knurled to facilitate frictional engagement with the bore 18 of the pipe 20. The clamping portions 66,68 may be enabled to move between a retracted position (FIGS. 1 and 2) in which the one or more shoe members 72,74 is positioned radially away from the bore of the pipe and an extended position (FIGS. 3 and 4) in which the one or more shoe members are forced radially outward to engage the bore of the pipe, and thereby assist in anchoring the frac plug in the desired position in the pipe of the down hole well. The cooperation of the clamp and seal engaging the bore of the pipe anchors the plug in the bore of the pipe of the well hole.

Figure 2:
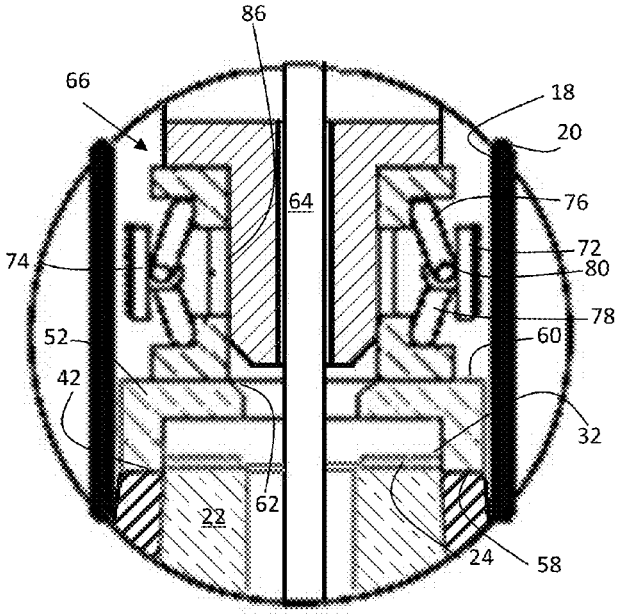
FIG. 2 is an enlarged, cross-sectional view of detail area 2-2 of FIG. 1.
Figure 3:
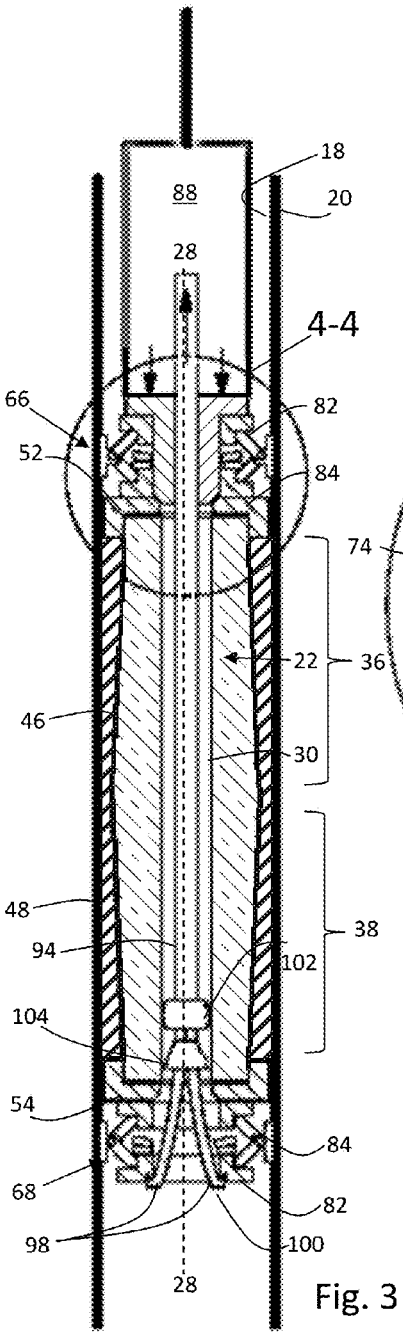
FIG. 3 is a cross-sectional view of the frac plug of FIG. 1 after an actuator has positioned a clamp and a seal to install the frac plug into the wellbore.
Figure 4:
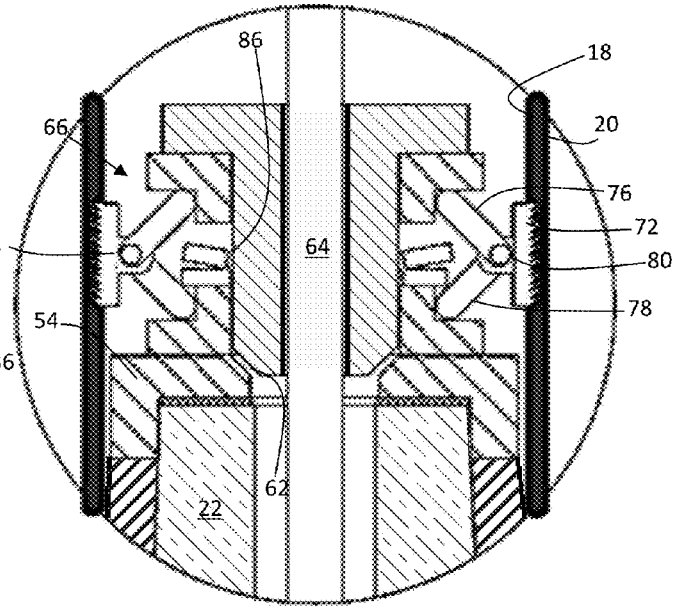
FIG. 4 is an enlarged, cross-sectional view of detail area 4-4 of FIG. 3.

Movement between the retracted and extended positions may be accomplished with a pair opposed levers 76,78 associated with each shoe member. The levers 76,78 may be pivotally mounted to pivot points 80 located on an inner surface of each shoe member. The pivot point for each of the levers 76,78 may be coaxial as shown. The opposite ends of the opposed levers may be pivotally connected to a set of spaced apart clamp flanges 82,84. One clamp flange 82 (i.e., a driven clamp flange) may be driven by the operator (or draw bar assembly) and the opposite clamp flange 84 (i.e. a stationary clamp flange) may abut the flat face 60 of setting key. When the clamping portion is in the retracted position such as shown in FIGS. 1 and 2, the clamp flanges 82,84 may be spaced apart at a first distance, thereby holding the clamping portion shoe members 72,74 away from the bore of the pipe. To move the shoe members 72,74 into engagement with the bore of the pipe, the clamp flanges 82,84 may be moved axially together to a second distance, thereby pivoting the levers 76,78 from a near vertical (or axial) position to a generally radial position forcing the shoe members 72,74 against the bore of the pipe. When the shoe members 72,74 contact the bore of the pipe, the clamp flanges are axially closer together at the second distance, for instance as shown in FIGS. 3 and 4.

A temporary stop 86 may be used to set the first position and temporarily prevent the clamp flange from moving toward the setting key and the second position. The temporary stop 86 may be arcuate pieces that in part surround the operator 64. The temporary stop 86 may be deformable such that when pressure is applied to the driven clamp flange 82 to move it toward the stationary clamp flange 84, the temporary stop may yield and allow the driven clamp flange to move axially toward the stationary clamp flange. As shown in FIGS. 3 and 4, with the coaxial location of the pivot points of the levers, axial movement of the clamp flange toward the setting key causes the levers to pivot in a scissors-like motion forcing the shoe members radially outward to engage the bore of the pipe. The connection between the shoe members and the levers may also include one or more a ratchet or pawl/detent system (not shown) to fix and lock the radial position of the levers and the shoe members with sufficient engagement pressure of the shoe against the bore of the pipe to assist in maintaining the position of the frac plug in the pipe of the downhole well. The ratchet system may lock the end of the lever adjacent to the pivot connection point to the pivot or a yoke of the pivot connection point. While the drawings show a pair of levers disposed between the clamp flanges, other arrangement may also be used. The stationary clamp flange may be omitted or integrally formed with the setting keys and placed in a spaced apart arrangement with the clamp flange. The clamping portion may also include one or more pairs of levers for each of the arcuate shoe members.

An actuator 88 may be provided to apply force to the clamp and engage the clamp with the bore of the pipe of the down hole well. The actuator 88 may also compress the seal. In one embodiment, the actuator 88 includes the actuator operator 64 which engages the driven clamp flange 82 of the first or top clamping portion 66 to move it toward the stationary clamp flange 84 and position the shoe members 72,74 of the first clamping portion. As shown in FIGS. 3 and 4, the actuator operator 64 moves the driven clamp flange 82 vertically down toward the stationary clamp flange 84, thereby deforming the temporary stop 86 and enabling the levers 76,78 to pivot to a position where the one or more shoe members 72,74 translate radially outward and engage against the bore of the pipe. The axial travel of the actuator operator 64 and the dimensions of the levers and the clamp flange may be set so that with the actuator operator engaging the clamp flange, the actuator operator may also engage the setting key to position the setting key to compress the seal outward to engage the bore of the pipe. The engagement may be simultaneous or near simultaneous.

The second or bottom clamping portion 68 may be arranged in a similar manner to the first clamping portion. The elements of the second clamping portion that are similar to the first clamping portion are indicated with corresponding reference characters. However, rather than being directly actuated by the actuator operator, the second clamping portion 68 may actuated with a draw bar 94 extending through the draw bar shaft opening 30 of the plug member. The draw bar 94 may have spring loaded clamp arms 98 at the draw bar distal end. Each clamp arm 98 may be formed with a claw 100 on its distal end that is shaped to engage the second or bottom clamping portion 68 driven clamp flange 82. The clamp arms 98 may be formed of a resilient or spring steel to enable the clamp arms to inherently spring toward each other at their distal ends when the arms are spread apart. The driven clamp flange 82 of the second clamping portion 68 may have indentations 101 (FIG. 8) that cooperate with the claws 100 of the clamp arms 98 to enable the claws to engage the driven clamp flange of the second clamping portion. To arrive at the configuration in FIG. 1, the frac plug may be initially set by spreading the clamps arms 98 apart with a spreading tool (not shown) such that the claws 100 have a radial spacing that may engage the indentations 101 of the bottom clamping portion 68 driven clamp flange 82, and the draw bar may be moved upward to place the claws in the indentations with initial tension against the temporary stop 86. Once the driven clamp flange 82 of the second clamping portion is engaged with the claws 100, the draw bar 94 may be moved vertically upward, deforming the temporary stop 86 and driving the clamp flange 82 toward the stationary clamp flange 84, and stationary clamp flange 84 against the bottom setting key 54, thus setting the second clamping portion in engagement with the bore of the pipe.

With the actuator operator 64 engaging the top or first clamping portion 66, and the spring arm claws 98 engaging the bottom or second clamping portion 68, the frac plug is armed and ready to be deployed in the wellbore. The draw bar 94 (i.e., and clamp arms 98) may be synchronized with the actuator 88 to enable movement simultaneously with the actuator operator 64. For instance, the draw bar 94 may be integrated with the actuator 88 to provide coordinated motion of the draw bar and actuator operator. The draw bar 94 may also be positionable axially in the draw bar shaft opening 30 independently of the actuator operator 88, for instance, during setting of the frac plug prior to deployment in the wellbore. Once positioned in the wellbore, the actuator 88 may be actuated in a manner to set the first and second clamping portions, and in so doing, the first and second setting keys 52,54 may be engaged in a coordinated motion allowing for uniform loading to be applied to the plug member. The draw bar 94 may have a centering guide 102 on its distal end to enable the draw bar 94 to move axially through the draw bar shaft opening 30 of the plug body with minimal radial movement. The draw bar 94 may also include an extraction band 104 around the clamp arms to support smooth removal of the clamp arms 98. The extraction band slides axially in the drawings around the clamp arm claws. A spring (not shown) may be provided between the distal end of the draw bar and the extraction band to urge the extraction band downward toward the claws when the claws are retracted to the relaxed, straight position, thereby preventing the claws from catching during extraction. A more detailed explanation of the coordinated motion of the draw bar and actuator operator follows below.

FIG. 1 shows the frac plug armed and in position within the wellbore with the claws 100 engaged with the driven clamp flange 82 of the second clamping portion 68. As mentioned above, to achieve engagement of the claws 100 with the driven clamp flange 82, the draw bar 94 may be moved vertically downward so that the spring arms 98 are positioned below the driven clamp flange 82 of the bottom clamping portion 68. At this position, the clamp arms 98 may be spread apart with a spreading tool to set a radial spacing of the claws 100 sufficient to engage the indentations of the driven clamp flange 82. To allow the clamp arms 98 to be spread, the extraction band 104 may be moved upward so that it is adjacent to the distal end of the draw bar and not limiting the spreading of the clamp arms. With this initial claw radial spacing set, the draw bar 94 may be moved vertically upward to allow the claws to insert into indentations 101 and engage the driven clamp flange as shown in FIG. 1. Simultaneously, or independently, the actuator operator 64 may be positioned to engage the driven clamp flange 82 of the first clamping portion 66 as shown in FIGS. 1 and 2.

FIGS. 3-4 show the clamp and seal being set in the bore of the pipe. With respect to the top or first clamping portion 66, the actuator operator 64 may be moved vertically downward so the actuator operator drives the driven clamp flange 82 downward and the first or top setting key 52 downward. In a coordinated fashion, the draw bar 94 may move vertically upward, thus moving the clamp arms 98 upward toward the actuator 88 causing the driven clamp flange 82 of the second clamp portion 68 to be driven into the stationary clamp flange 84, and the stationary clamp flange into the bottom or second setting key 54. The simultaneous (or near simultaneously) movement of the draw bar assembly 94 vertically upward and the actuator operator 64 vertically downward enables the first and second clamping members 66,68 to move radially outward and engage the bore of the pipe, and the first sealing member 46 to move against the second sealing member 48 to compress the seal 40 against the bore of the pipe.

Figure 5:
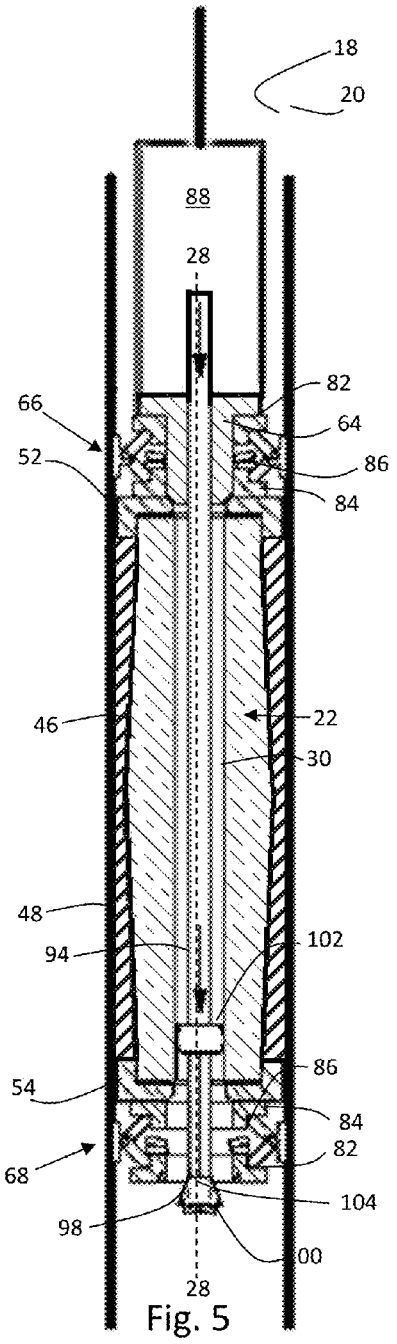
FIG. 5 is a cross-sectional view of the frac plug of FIG. 1 further illustrating an actuator positioning the clamp and the seal inside the wellbore.
Figure 6:
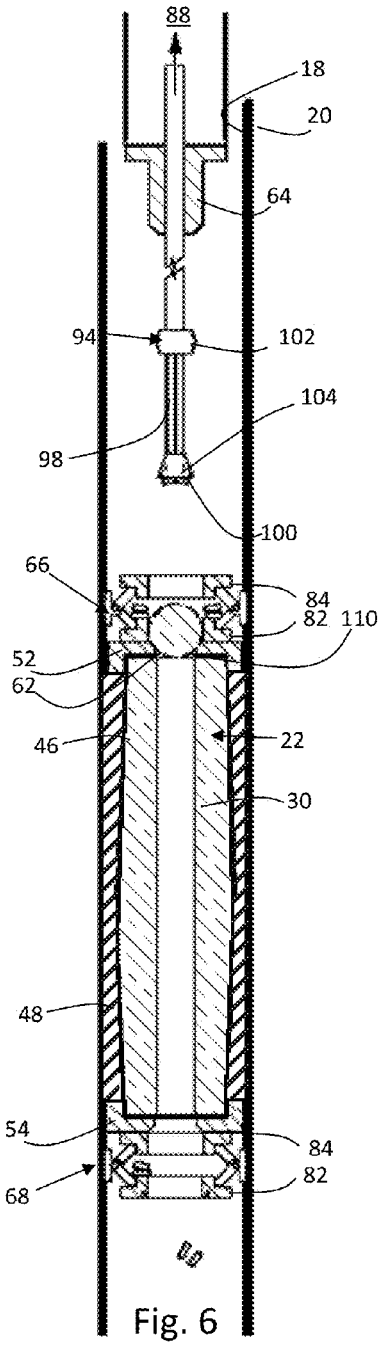
FIG. 6 is a cross-sectional view of the frac plug of FIG. 1 fully installed in the wellbore with a frangible frac ball in place to regulate flow through the pipe.

FIGS. 5-6 show the positions of the draw bar 94 and actuator operator 64 after the clamp and seal have been set in position. To allow the draw bar 94 to be removed from the frac plug after the clamping portions have been set in place, the draw bar 94 and the clamp arms 98 may be moved vertically downward to disengage the claws 100 from the driven clamp flange 82 of the bottom clamping portion 68. The downward motion of the draw bar 94 causes the claws 100 to disengage the indentations 101, the clamp arms 98 to spring return together, and the extraction band to slide downward to secure the claws together and cover the claws. Once the claws 100 are secured so the clamp arms 98 clear the bore of the clamp flanges 82,84 and the setting key 54, and draw bar shaft opening 30, the draw bar 94 may be withdrawn from the frac plug. In FIG. 5, the extraction band 104 is in the lowered position securing the claws together. FIG. 6 shows the actuator operator 64 and the draw bar 94 withdrawn from the frac plug. Each component may be moved vertically upward independently or in a coordinated fashion, through the actuator 88.

Once the actuator operator 64 and draw bar assembly 94 have been removed from the bore of the pipe, the frac plug 10 is ready for service and may receive a frac ball 110 positioned at the top axial end of the plug member 22. The top clamping portion 66 may have a bore configured to receive the frac ball 110. For instance, the bores of the driven and stationary clamp flanges of the top clamping portion may be configured to receive the frac ball. The top setting key 52 seating surface 62 is configured to form a valve seat for the frac ball 110. Other conventional internal valve components, for instance, packing, glands, a valve operator, etc. (not shown) may be provided in the top clamping portion 66 to cooperate with the frac ball to form a valve as required by the application. The frac ball 110 may form a pilot valve body with the plug member draw bar shaft opening 30 forming a pilot opening for the pilot valve. The frac ball 110 may be formed from a high strength glass or other frangible material in a manner similar to the glass material of the plug member described above. In particular, the frac ball may be formed to withstand over 20,000 psi in compression and temperatures over 400 degrees Celsius. The frac ball may be coated with a thin layer of plastic to protect the ball from incidental or non-intentional piercing. The frac ball may be removed from the system to reestablish flow in the well by piercing its surface to cause the ball to disintegrate.

Figure 7:
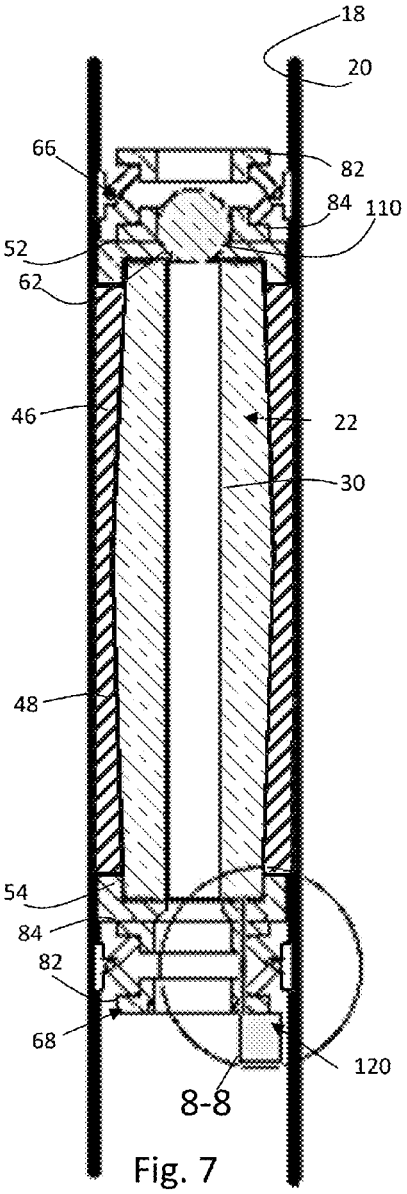
FIG. 7 is a cross-sectional view of an alternate embodiment of the frac plug of FIG. 6 installed in the bore of the pipe wherein the frac plug comprises an impinging assembly for disintegrating the frac plug.
Figure 8:
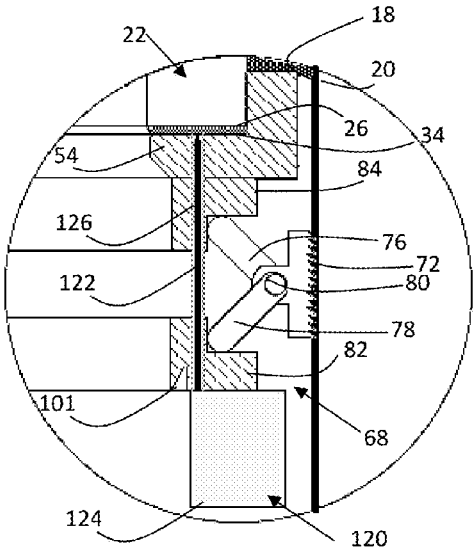
FIG. 8 is an enlarged cross-sectional view of detail area 8-8 of FIG. 7.
Figure 9:
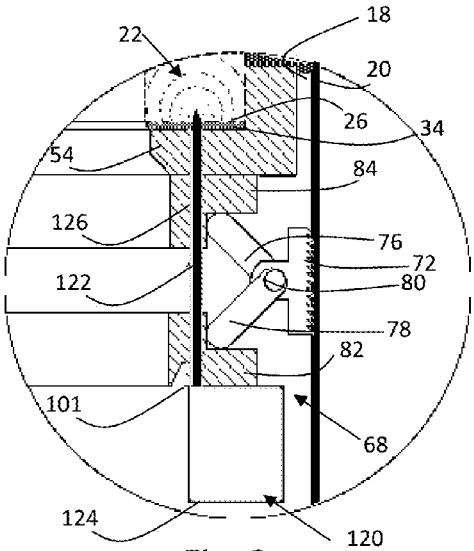
FIG. 9 is an enlarged cross-sectional view of detail view 8-8 of FIG. 7 but illustrating a pin of the impinging assembly striking the glass portion of the plug to disintegrate the plug and reestablish flow in the pipe.

FIGS. 7-9 show an alternate embodiment of the frac plug that includes an impinging assembly 120 positioned on the driven clamp flange 82 of the second clamping portion 68. The impinging assembly 120 may include a pin 122 connected to an actuator 124. The pin 122 may be positioned adjacent the axial opposite end 26 of the plug member 22. Accordingly, the driven clamp flange 82 and setting key 54 may have aligned passageways 126 allowing the pin 122 to strike an axial end of the plug member through the protective pad 34. Upon actuation, the pin 122 may be driven into the plug 22 member causing the plug member to disintegrate thereby enabling the frac plug 10 to be removed from the bore 18 of the pipe 20 to reestablish flow in the pipe as desired. The pin 122 may be formed from a hardened material, for instance, tungsten carbide, tungsten, boron carbide. The pin 122 may have a sharpened edge to enable it to penetrate the glass material of the plug member 22. The actuator 124 may be remotely actuated via a wireless transmission, and may include hydraulics, compressed gas, an explosive, or a solenoid actuated spring to drive the pin 122 into the glass material of the plug member. The actuator may also be operated locally. Because the plug member 22 comprises glass material that is formed in ultra-high compression, the glass material easily disintegrates upon being impinged by the pin. Once disintegrated, the glass powder and small components fall away to the bottom of the well. In an alternative, the pin 122 may act as a firing pin and direct a small ballistic such as a bullet or a cartridge into the glass through the passageway 126. Although the drawings show the impinging assembly 120 mounted to the bottom or second clamping portion 68 and the driven clamp flange 82, the impinging assembly may be mounted to the top or first clamp portion clamp flange or adjacent thereto.

In view of the foregoing, it will be seen that the several advantages are achieved and attained. The embodiments were chosen and described in order to best explain the practical application to thereby enable others skilled in the art to best utilize the various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A frac plug configured to seal a bore of a pipe of a downhole well, the frac plug comprising:

a generally cylindrical plug member comprising a glass body, the plug member having axial opposite ends and a length extending between the axial ends, the plug member having an outer diameter surface extending along the length, the outer diameter surface being tapered, the plug member having an internal passageway;

a seal of compressible material extending substantially around the plug member outer diameter, the seal having opposite axial ends generally corresponding to the axial ends of the plug member, the seal being movable axially relative to the plug member outer diameter surface, the seal being compressible against the plug member outer diameter surface and expandable radially outward to engage the bore of the pipe;

a frac ball disposed within the frac plug, the frac ball being configured to control flow through the plug member internal passageway, the frac ball being formed from a glass material:

a clamp configured to engage the bore of the pipe in a manner to secure the frac plug in the bore of the pipe, and wherein the clamp has a first clamping portion adjacent to one axial end of the plug member and a second clamping portion adjacent to the opposite axial end of the plug member; and wherein the first clamping portion has a chamber in communication with the plug member internal passageway.

2. A frac plug configured to seal a bore of a pipe of a downhole well, the frac plug comprising:

a generally cylindrical plug member comprising a glass body, the plug member having axial opposite ends and a length extending between the axial ends, the plug member having an outer diameter surface extending along the length, the outer diameter surface being tapered, the plug member having an internal passageway;

a seal of compressible material extending substantially around the plug member outer diameter, the seal having opposite axial ends generally corresponding to the axial ends of the plug member, the seal being movable axially relative to the plug member outer diameter surface, the seal being compressible against the plug member outer diameter surface and expandable radially outward to engage the bore of the pipe;

a frac ball disposed within the frac plug, the frac ball being configured to control flow through the plug member internal passageway, the frac ball being formed from a glass material:

a clamp configured to engage the bore of the pipe in a manner to secure the frac plug in the bore of the pipe, and wherein the clamp has a first clamping portion adjacent to one axial end of the plug member and a second clamping portion adjacent to the opposite axial end of the plug member; and wherein the frac ball is received in the chamber formed in the first clamping portion.

3. A frac plug configured to seal a bore of a pipe of a downhole well, the frac plug comprising:

a generally cylindrical plug member comprising a glass body, the plug member having axial opposite ends and a length extending between the axial ends, the plug member having an outer diameter surface extending along the length, the outer diameter surface being tapered;

a seal of compressible material extending substantially around the plug member outer diameter, the seal having opposite axial ends generally corresponding to the axial ends of the plug member, the seal being movable axially relative to the plug member outer diameter surface, the seal being compressible against the plug member outer diameter surface and expandable radially outward to engage the bore of the pipe; and an impinging assembly comprising a striker, the impinging assembly being configured to drive the striker into the plug member glass body with sufficient force to cause the glass body to break in manner to establish flow between axial ends of the plug member;

wherein the impinging assembly is configured to receive signals wirelessly to cause the striker to be driven into the plug member glass body.

* * * * *